US007065914B1

(12) United States Patent
Wagner, II

(10) Patent No.: US 7,065,914 B1
(45) Date of Patent: Jun. 27, 2006

(54) STOCK ARM MONOPOD

(76) Inventor: William Fredrick Wagner, II, 442 Clearfield Ave., Franklinville, NJ (US) 08322

( * ) Notice: Subject to any disclaimer, the term of this patent is extended or adjusted under 35 U.S.C. 154(b) by 0 days.

(21) Appl. No.: 11/039,485

(22) Filed: Jan. 18, 2005

(51) Int. Cl.
*F41C 23/00* (2006.01)

(52) U.S. Cl. ..... 42/73; 42/74; 124/74

(58) Field of Classification Search ..... 42/73, 42/74, 71.02, 94, 71.01; 124/74, 75, 76, 124/77; 89/37.04
See application file for complete search history.

(56) References Cited

U.S. PATENT DOCUMENTS

| | | | | |
|---|---|---|---|---|
| 2,441,487 | A * | 5/1948 | Howard | 42/72 |
| 3,553,878 | A * | 1/1971 | Canon | 42/94 |
| 5,641,147 | A * | 6/1997 | Pena | 473/552 |
| D395,070 | S * | 6/1998 | McGowan | D22/108 |
| 5,784,820 | A * | 7/1998 | Wood | 42/94 |
| 5,930,931 | A * | 8/1999 | Watson | 42/94 |
| 6,553,707 | B1 | 4/2003 | Tseng | |
| 6,591,533 | B1 | 7/2003 | Wygant | |
| 6,732,726 | B1 * | 5/2004 | Ho | 124/74 |
| 6,889,465 | B1 * | 5/2005 | Holmes | 42/94 |
| 2002/0117159 | A1 * | 8/2002 | Kotsiopoulos et al. | 124/51.1 |
| 2005/0262753 | A1 * | 12/2005 | Lahti | 42/94 |

* cited by examiner

*Primary Examiner*—Michael J. Carone
*Assistant Examiner*—Stewart Knox
(74) *Attorney, Agent, or Firm*—Norman E. Lehrer

(57) ABSTRACT

A tank mountable stock arm monopod for pneumatic guns or the like has an arm mounting saddle fastened to the compressed gas tank of a pneumatic gun with adjustable stabilizing straps. The arm mounting saddle has a pivotally mounted coupling that connects with the arm mounting saddle and the lower stock arm. The lower stock arm comprising of a cylindrical section that fits into the saddle arm coupling. The sliding upper stock arm is a cylindrical section smaller in diameter than the lower section enabling the sliding section to fit and move inside the stationary section in a telescoping movement, allowing the length of the stock to adjust to the user. A stock arm butt is pivotally mounted to the sliding stock arm opposite the stationary stock arm. The stock arm monopod is put into the monopod position by loosening the stabilization straps and spinning the apparatus 180 degrees so that the stock arm butt is pointing towards the playing surface. The monopod is adjusted in the same manner as in the stock arm configuration. The stock arm monopod is adjustable, universal to all pneumatic guns that employ a compressed gas tank and can be mounted, dismounted and adjusted in the field without the use of tools.

8 Claims, 3 Drawing Sheets

SHOWN IN STOCK ARM POSITION

SHOWN IN STOCK ARM POSITION

SHOWN IN MONOPOD POSITION

EXPLODED ISOMETRIC VIEW

SHOWN ASSEMBLED

STOCK ARM MONOPOD

RELATED APPLICATIONS

Not Applicable

STATEMENT REGARDING FEDERALLY SPONSORED RESEARCH AND DEVELOPMENT

Not Applicable

BACKGROUND OF THE INVENTION

The present invention relates to pneumatic guns, more particularly a stock for pneumatic paintball guns.

The recent emergence of pneumatic guns for recreational games has gained popularity, specifically paintball games. An array of paintball guns (markers) are currently available through numerous manufacturers. The majority of these guns are not designed to include stocks and when the stocks are available, most are specific to gun make and/or model, are limited in their adjustability and require tools to mount and dismount. Therefore, there is a current need for a universal, adjustable gunstock, which can be mounted, dismounted and adjusted in the field without the use of tools.

It is the objective of this invention to provide a multipurpose stock arm monopod for pneumatic guns that employ compressed gas tanks. The stock arm monopod is universal, adjustable and can be quickly and easily adjusted, mounted and dismounted in the field without the use of tools. The stock arm monopod includes an arm mounting saddle, which connects the stock to a compressed gas tank. The arm mounting saddle is attached to a compressed gas tank with two adjustable stabilization straps. The stabilization straps and arm mounting saddle rest on a non-slip sleeve. The arm mounting saddle connects to a pivotally mounted coupling to which the lower stock arm connects with. The saddle arm coupling is pivotally mounted for movement between the vertical and horizontal positions. The lower stock arm is a diameter, which is large enough to accept the sliding upper stock arm inside of it for telescoping movement of the sliding upper stock arm. The sliding upper stock arm is held into desired position by a compression lock positioned at the top end of the lower stock arm. The sliding upper stock arm has a pivotally mounted sliding arm coupling at its upper most section that connects to the stock arm butt. The stock arm butt is substantially concave and is connected to the sliding arm coupling. The stock arm monopod can be configured into the monopod position by loosening the stabilization straps, spinning the apparatus 180 degrees and placing the stock arm downwards. The monopod configuration allows the apparatus to rest on playing surface for improved gun aiming and to bear a portion of the gun's weight.

Other objects of this invention will be obvious and will appear hereinafter

This invention comprises the apparatuses and systems, together with their parts, elements and interrelationships that are represented in the following disclosure, the scope of which will be specified in the attached claims.

A comprehensive understanding of the nature and components of the present invention will be apparent with the consideration of the detailed description along with the associated drawings, wherein:

DRAWING FIGURES

DRAWINGS REFERENCE NUMBERS

| Reference Number | Quantity | Description |
|---|---|---|
| 1 | 2 | Stabilizing strap |
| 2 | 1 | Arm mounting saddle w/sleeve |
| 3 | 1 | Saddle arm coupling |
| 4 | 1 | Lower stock arm |
| 5 | 1 | Compression lock |
| 6 | 1 | Sliding stock arm |
| 7 | 1 | Sliding arm coupling |
| 8 | 1 | Stock arm butt |
| 9 | 2 | Hex bolt |
| 10 | 2 | Wing nut |
| 12 | 1 | Stock arm monopod |

Figure 1:
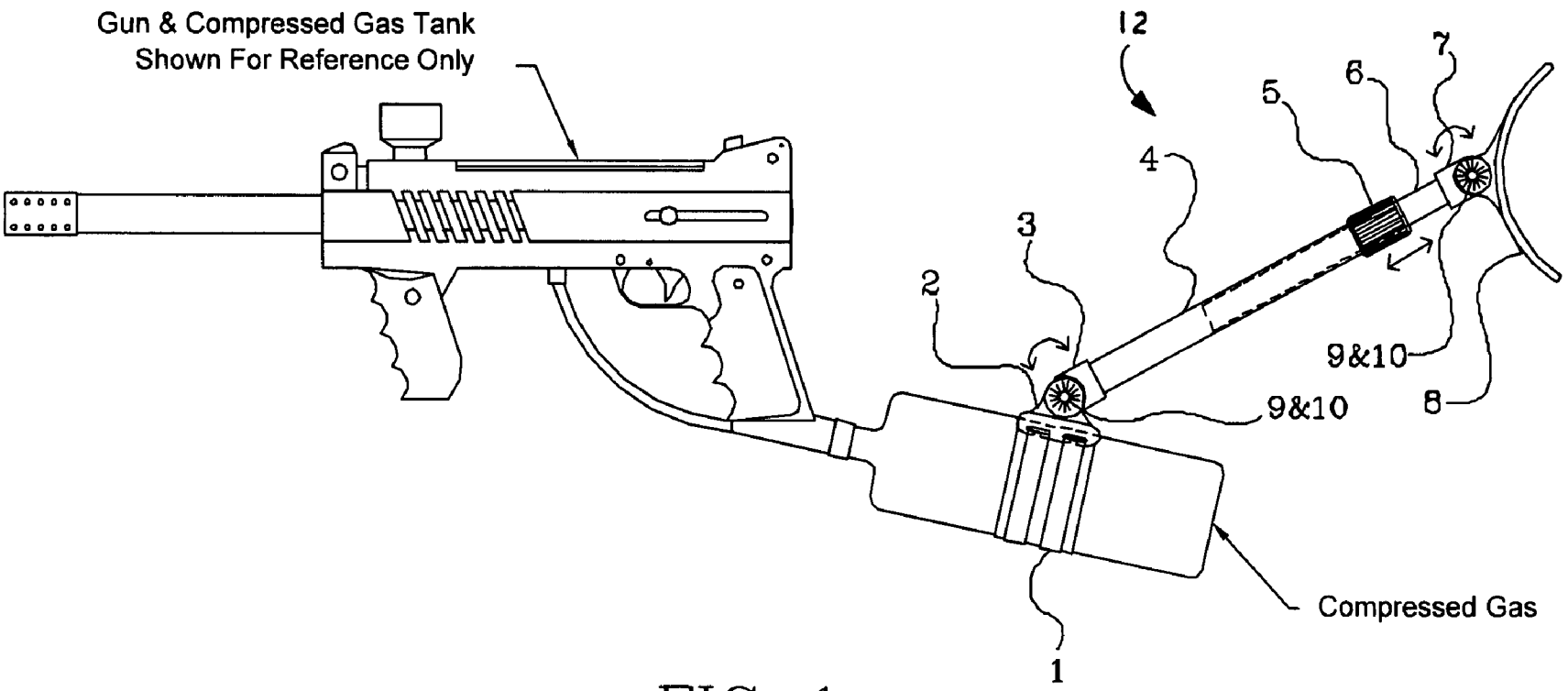
FIG. 1 is a side view of the stock arm of FIG. 4 in its mounted stock arm configuration.

Referring to the drawings, in FIG. 1 there is shown a stock arm monopod 12 representing the present invention mounted to the compressed gas tank of a pneumatic gun. As described below, stock arm monopod 12 is an adjustable stock arm shown in FIG. 1 and an adjustable monopod shown in FIG. 2.

Stock arm monopod 12 includes an arm mounting saddle with non-slip sleeve 2, a saddle arm coupling 3, a lower stock arm 4, a compression lock 5, a sliding upper stock arm 6, a sliding arm coupling 7 and a stock arm butt 8. A pair of stabilizing straps 1 is provided for holding the arm mounting saddle to a compressed gas tank. Bolt 9 and wing nut 10 are used to attach saddle arm coupling 3 to arm mounting saddle 2. Bolt 9 and wing nut 10 are loosened to allow pivotal movement of the stock arm from a vertical position to a horizontal position relative to the long part of the paintball gun and tightened when stock arm is at the desired angle. The lower stock arm 4 is attached into saddle arm coupling, for example with threads. The upper sliding stock arm 6, rest inside of the lower stock arm 4 and is adjusted in a telescoping motion. The lower stock arm 4 is fitted with a compression lock 5 to lock sliding upper stock arm 6 in the desired position. Upper sliding stock arm 6 end opposite the lower stock arm 4, is attached inside of sliding arm coupling 7, for example with threads. Bolt 9 and wing nut 10 are used to attach stock arm butt coupling 7 to stock arm butt 8. Bolt 7 and wing nut 10 are loosened to allow pivotal movement of stock arm butt 8 and has a range of motion greater than 70 degrees relative to the long axis of sliding upper stock 6. Bolt 9 and wing nut 10 are tightened when stock arm butt 8 is at the desired angle.

Arm mounting saddle 2 is a substantially concave member, for example plastic. The bottom mounting side of the arm mounting saddle 2 is substantially concave for mounting onto a cylindrical compressed gas tank of a pneumatic gun. On each left and right flanks of the concave part of the arm mounting saddle 2 are two slots for fastening stabilizing straps 1. The top of the arm mounting saddle 2, on stock arm mounting side, are two circular, ribbed-surfaced flanges with holes for bolt 9 to which saddle arm coupling 3 is attached with bolt 9 and wing nut 10.

Stabilizing straps 1 are flexible, flat band shaped, ratcheting buckle, for example plastic, used for securing arm mounting saddle 2 to a compressed gas tank of a pneumatic gun. Stabilizing straps 1 feed through slots on the arm mounting saddle, wrap around the compressed gas tank and fasten opposite arm mounting saddle 2.

Saddle arm coupling 3, a member that includes a tongue side and a lower stock arm 4 receiving side, for example plastic. The tongue side is a rounded, ribbed-surfaced and is a thickness that of which will fit between the two flanges of the arm mounting saddle 2. The tongue includes a center hole for bolt 9 to fit through.

Lower stock arm 4, a substantially cylindrical member, for example a hollow aluminum pipe, connects on one end to saddle arm coupling 3, for example with threads. The opposite end of the lower stock arm 4 is fitted with compression lock 5. Compression lock 5, a substantially cylindrical member, for example aluminum fitting, Compression lock 5 is used to hold sliding upper stock arm 6 in its selected position. Compression lock 5 is turned clockwise to tighten and counter clockwise to loosen.

Sliding upper stock arm 6, a substantially cylindrical member, for example a hollow aluminum pipe, has an outer diameter that is less than the inner diameter of the lower stock arm 4 and compression lock 5. The sliding upper stock arm fits inside lower stock arm 4, is moved in and out in a sliding telescoping motion for length adjustment and is secured in place with compression lock 5.

The opposite end of sliding upper stock arm connects to sliding arm coupling 7, for example with threads.

Sliding arm coupling 7, a member that includes a tongue side and a sliding upper stock arm receiving side, for example plastic. The tongue side is a rounded, ribbed-surfaced and is a thickness that of which will fit between the two flanges of stock arm butt 8. The tongue includes a center hole for bolt 9 to fit through.

Stock arm butt 8, a substantially concave member, for example plastic, includes two circular, ribbed-surfaced flanges with center holes for bolt 9 to which sliding arm coupling 7 is attached with bolt 9 and wing nut 10.

Figures 3, 4:
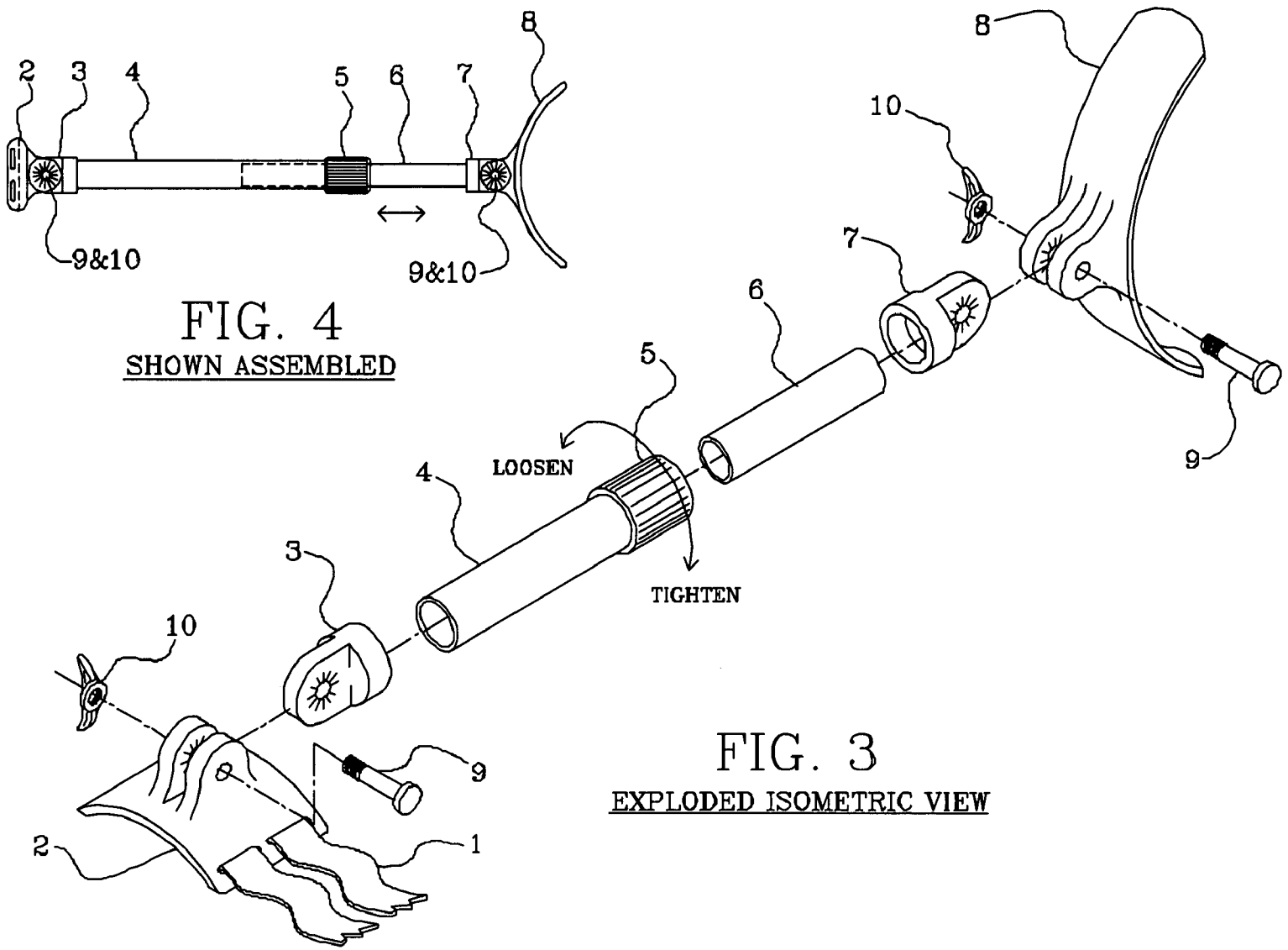
FIG. 3 is an exploded isometric view of the stock arm of FIG. 4 in a dismounted position.
FIG. 4 is a side view of the dismounted stock arm monopod

When the stock arm monopod 12 is in the stock arm position, shown in FIG. 1, arm mounting saddle 2 rest on the top side of the compressed gas tank of a pneumatic gun. The assembled stock arm, FIG. 4, is pointing away from the pneumatic gun and towards the gun's user. Adjustment of the angle of stock arm 12 is achieved by loosening wing nut 10 on the saddle arm coupling, moving the stock arm forward or back to desired angle and tightening wing nut 10. The length of stock arm 12 is changed by loosening compression nut 5, moving sliding upper stock arm 6 in and out, in a telescoping motion, to desired length and tightening compression nut 5. The angle of stock arm butt 8 is adjusted by loosening wing nut 10 on the sliding arm coupling 7, pivoting stock arm butt 8 forward and back to desired angle and tightening wing nut 10 on the sliding arm coupling 7. The stock arm monopod in the stock arm position, FIG. 1, is used by placing stock arm butt into the user's shoulder, for example, therefore stabilizing the pneumatic gun, allowing improved aiming and bearing a portion of the gun's weight.

Figure 2:
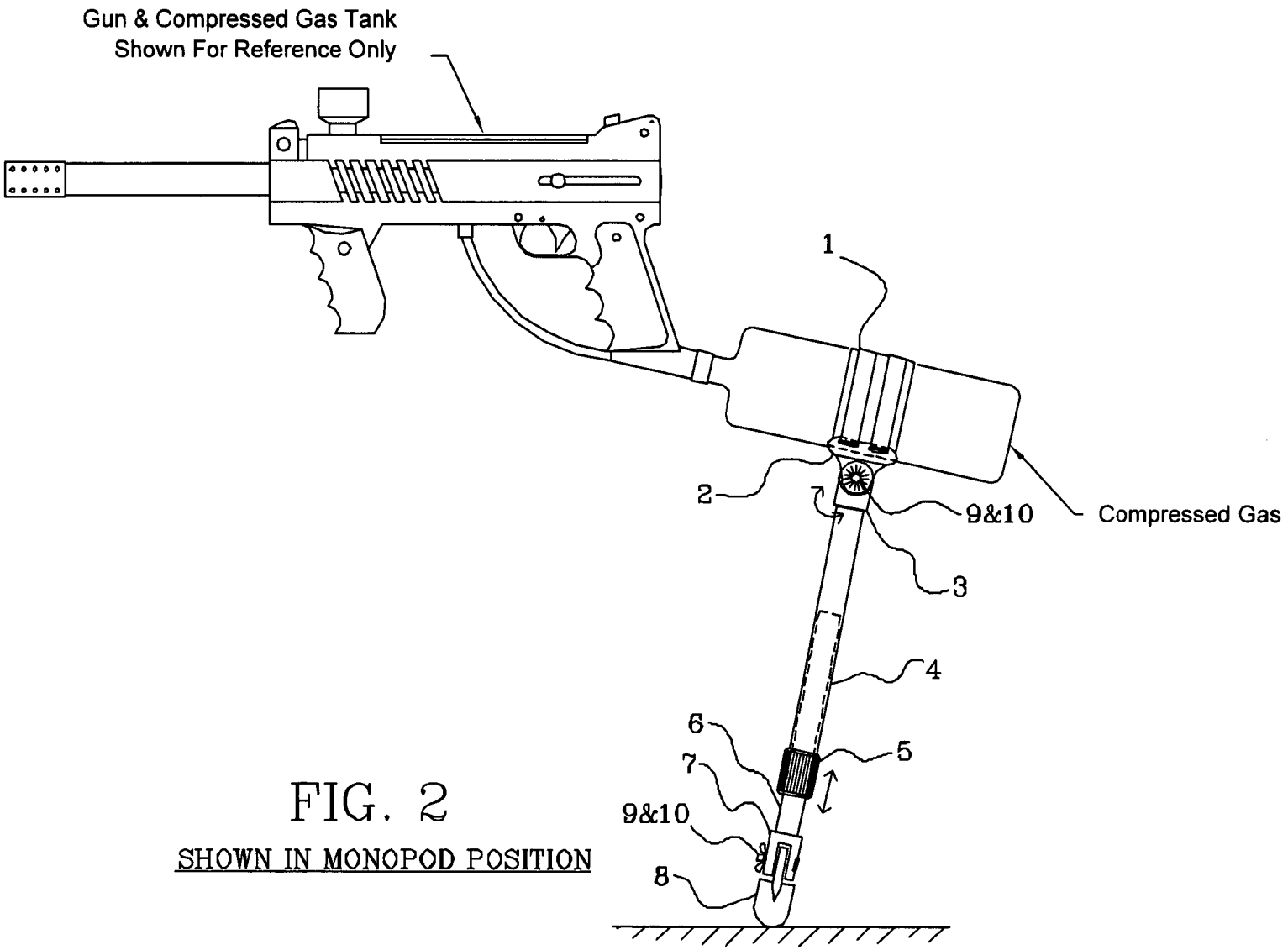
FIG. 2 is a side view of the stock arm of FIG. 4 in its mounted monopod configuration.

When the stock arm monopod 12 is in the monopod position, FIG. 2, arm mounting saddle 2 rest on the bottom side of the compressed gas tank of a pneumatic gun. The assembled stock arm, FIG. 4, is pointing downwards towards the playing surface. The angle of monopod is adjusted by loosening wing nut 10 on the saddle arm coupling, moving the stock arm forward or back to desired angle and tightening wing nut 10. The length of monopod is changed by loosening compression nut 5, moving sliding upper stock arm 6 in and out, in a telescoping motion, to desired length and tightening compression nut 5. The angle of stock arm butt 8 is adjusted by loosening wing nut 10 on the sliding arm coupling 7, pivoting stock arm butt 8 forward and back to desired angle and tightening wing nut 10 on the sliding arm coupling 7. The stock arm monopod 12 in the monopod position, FIG. 2, allows the pneumatic gun user to rest stock arm butt onto the playing surface for improved gun stability and a reduction in the weight load of the pneumatic gun on the user.

I claim:

1. In a pneumatic gun assembly having a compressed air tank, the improvement comprising:

a stock arm having a first end and a second end;

securing means secured to said compressed air tank;

means for pivotably mounting said first end of said stock arm to said securing means;

a stock arm butt; and means for pivotably mounting said stock arm butt to said second end of said stock arm;

wherein said stock arm and said stock arm butt may each be pivoted from a generally vertical position to a generally horizontal position.

2. The improvement of claim 1 wherein said arm may be secured in a generally horizontal position where said stock arm butt may rest on a person's shoulder or in a generally vertical position where said stock arm butt rests on a horizontal surface.

3. The improvement of claim 1 wherein said securing means includes a concave member and means for attaching said concave member to said tank.

4. The improvement of claim 3 wherein said means for attaching includes a plurality of straps arranged about a portion of said tank.

5. The improvement of claim 3 wherein said means for pivotably mounting said arm to said securing means includes two flanges with an aperture formed within each, said flanges extending outwardly from said concave member, a coupling with an aperture formed therein secured to said first end of said arm, and a nut and bolt assembly, said apertures of said flanges and said coupling being aligned so that said stock arm is placed in a desired position, said bolt being inserted through said apertures and being secured by said nut.

6. The improvement of claim 1 wherein said stock arm is comprised of two telescoping parts so as to allow the length thereof to be adjusted.

7. The improvement of claim 6 further including means for locking said arm in position after the length thereof has been adjusted.

8. The improvement of claim 1 wherein said means for pivotably mounting said stock arm butt to said stock arm includes a coupling with an aperture formed therein secured to said second end of said stock arm, two flanges with an aperture formed within each, said flanges extending outwardly from said stock arm butt, and a nut and bolt assembly, said apertures of said flanges and said coupling being aligned so that said stock arm butt is placed in a desired position, said bolt being inserted through said apertures and being secured by said nut.

* * * * *